US005112289A

United States Patent [19]

Köhn

[11] Patent Number: 5,112,289

[45] Date of Patent: May 12, 1992

[54] DEVICE FOR TRANSVERSE CUTTING AND WELDING OF WEBS

[75] Inventor: Uwe Köhn, Bielefeld, Fed. Rep. of Germany

[73] Assignee: Windmoller & Holscher, Lengerich, Fed. Rep. of Germany

[21] Appl. No.: 602,950

[22] Filed: Oct. 25, 1990

[30] Foreign Application Priority Data

Nov. 2, 1989 [DE] Fed. Rep. of Germany ..... 3936515

[51] Int. Cl.[5] ..... B31B 23/10; B31B 1/08; B31B 23/16

[52] U.S. Cl. ..... 493/194; 493/24; 493/29; 493/204

[58] Field of Search ..... 493/24, 29, 194, 204

[56] References Cited

U.S. PATENT DOCUMENTS

| | | | |
|---|---|---|---|
| 4,070,951 | 1/1978 | Bala | 493/24 |
| 4,101,369 | 7/1978 | Adams | 156/510 |
| 4,105,489 | 8/1978 | Lotto | 156/510 |
| 4,207,136 | 6/1980 | Schulze | 156/515 |
| 4,490,207 | 12/1984 | Achelpohl | 156/494 |

FOREIGN PATENT DOCUMENTS

| | | | |
|---|---|---|---|
| 2755860 | 1/1979 | Fed. Rep. of Germany . | |
| 3204492 | 8/1983 | Fed. Rep. of Germany . | |
| 3937536 | 5/1990 | Fed. Rep. of Germany | 413/24 |
| 1485253 | 5/1987 | France . | |
| 944776 | 12/1963 | United Kingdom . | |

*Primary Examiner*—William E. Terrell

*Attorney, Agent, or Firm*—Fleit, Jacobson, Cohn, Price, Holman & Stern

[57] ABSTRACT

In a device for transversely welding and cutting tubular film into bags, feed rolls advance the film to a gripping rail which grips the leading end of the film during operation of cutting and welding devices located behind the gripping rail in the direction of feed. To ensure proper tensioning of the film, the feed rollers are reversed after the film is gripped and prior to operation of the cutting and welding devices.

3 Claims, 1 Drawing Sheet

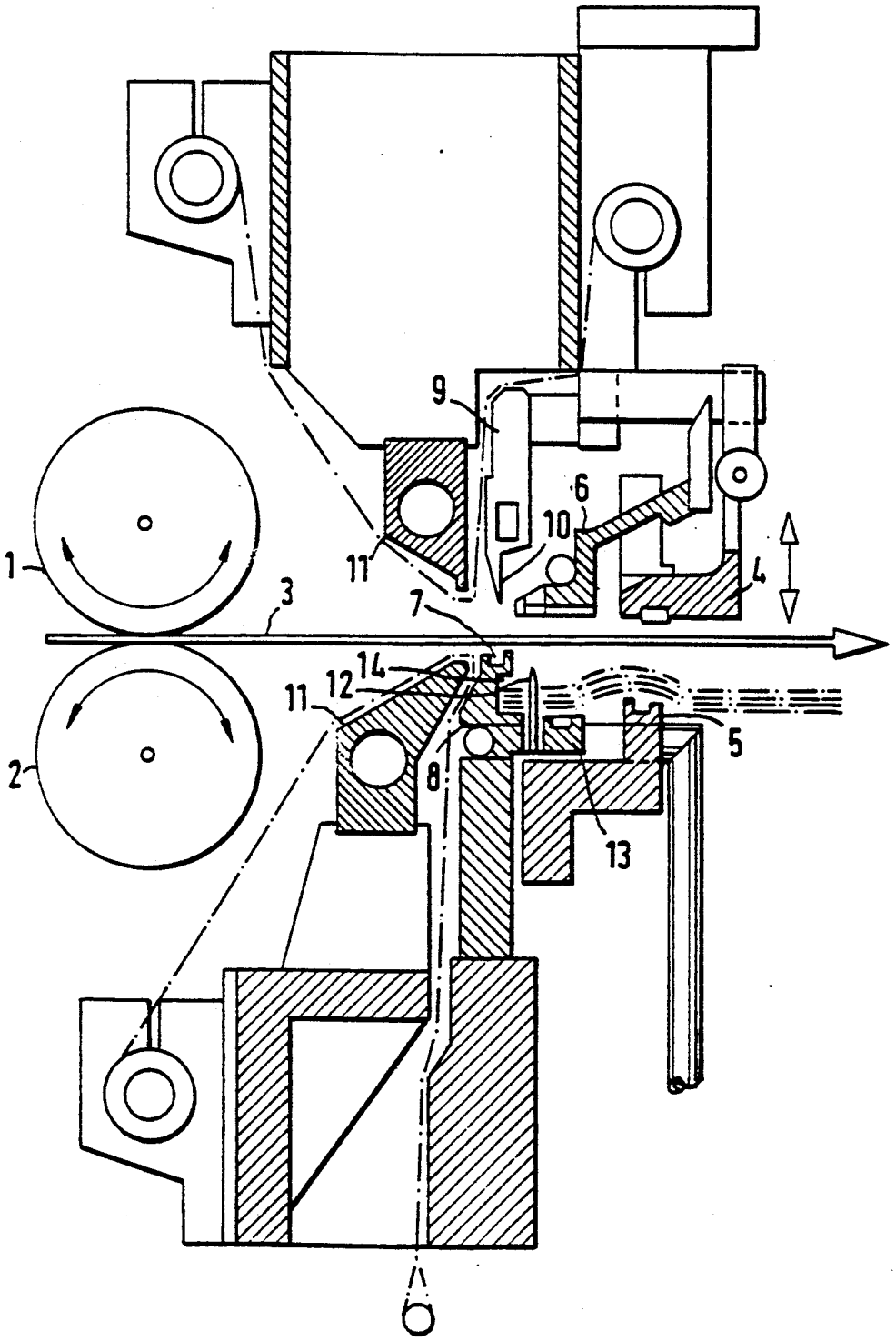
1
2
3
4
5
6
7
8
9
10
11
11
12
13
14

DEVICE FOR TRANSVERSE CUTTING AND WELDING OF WEBS

BACKGROUND OF THE INVENTION

This invention relates to a device for transverse cutting and welding of webs of thermoplastic plastic, more particularly webs in the form of a tubular film used for the manufacture of bags. The device comprises a pair of feed rolls for feeding the web in steps equal to the length to which the web is to be cut, a transverse cutting knife, preferably parallel to a transverse welding device and preferably heated, and two vertically movable rails placed parallel to each other in the direction of web feed. The rail which is downstream in the direction of feed acts as a gripping rail for pressing the end of the web, fed between the jaws of the transverse cutting device, against a support. The second rail, which is arranged between the cutting knife and the gripping rail, acts as a holding rail for tensioning the web which is gripped between the pair of feed rolls and the gripping rail before the cutting knife cuts the web.

In a device of the above kind, as described in German patent publication 3,204,492 A, it is possible for a section of the web which has been advanced between the jaws of the transverse welding device and under the cutting knife, and which has been held between the pair of feed rolls and the gripping rail, to be so slack that it may not be clamped in the desired manner by lowering the gripping rail.

If insufficient tension is produced by lowering the gripping rail, it is not possible for a severing cut to be produced. Therefore jamming between the cutting edges—as may be caused the heated severing knives—may not be reliably overcome.

SUMMARY OF THE INVENTION

One object of the invention is to design a device of the initially mentioned type, in which the gripping rail produces a tensioning effect in the gripped section of web so as to ensure a good severing cut and overcoming any potential jamming problem.

In a device in accordance with the invention, the feed roller part is subject to a drive movement drawing back the web during an interval of time which comes before the formation of the transverse weld seam. The pair of feed rolls perform a small reverse motion after feeding of the web so that any folds or slack in the web are taken up by drawing the web taut.

A further feature of the invention is that the pair of feed rolls may advance the web in steps through a distance which is greater than the length to which the web is cut. The pulling back motion causes the excess length to be pulled back again by the pair of feed rolls, so that the web is pulled to smooth it out. In this respect the amount of the backward pulling motion is chosen to match the excess amount by which the web is advanced.

It is convenient if the pulling back of the web takes place after the web has been gripped by the holding rail. When the advanced leading end of the web is gripped between the holding rail and a support, the web may be drawn into a properly smooth state by pulling it backwards.

It is convenient if the web is pulled back along a length which is equal to the difference between the length of advance and the length to which the web is cut. The length along which the web is pulled back may be adapted to suit the desired state of tensioning. The holding rail may draw the advanced section of web taut even while it is moving back, or later, and only after the web has been pulled back.

Furthermore it is possible for the knife to cut the web even while it is being pulled back.

BRIEF DESCRIPTION OF DRAWING

One working embodiment of the invention will be described in detail with reference to the drawing, the single figure of which is a diagrammatic cross sectional view through a transverse welding and cutting device.

DESCRIPTION OF PREFERRED EMBODIMENT

In a device for the production of plastic bags shown in the drawing, a pair of feed rolls 1,2 advance a plastic web 3 of tubular film in steps equal to the length of a bag. During the dwells of the feed rolls 1 and 2, the web 3 is clamped between the rolls. It is possible to provide air nozzles, not shown, to cause the leading end of the web of tubular plastic film to be fed in a taut condition. When the feed rolls 1 and 2 have fed a sufficiently long piece of tubular web, a depressing device, consisting of a gripping rail 4, moves down onto a support 5 so that the web is gripped on the one hand between the feed rolls 1 and 2 and on the other hand between the gripping rail 4 and the support 5 or, respectively, the stack of bags (shown in chain dotted lines) accumulating on the support. Then a holding rail 6 moves downwards and presses the web 3 sufficiently firmly in the downward direction that the latter is drawn taut over a groove 7 in a mating gripping rail 8. The web 3 is then severed by moving down an upper cutting knife holder 9 with a transverse cutting knife 10 thereon. Generally simultaneously with this, or directly thereafter, a permanently heated pair of welding jaws 11 is used to form a bottom transverse weld in the web.

Directly after the out has been made, the holding rail 6 moves even further downwards and while so doing presses the bag severed from the web 3 onto a loading rail 13 which is connected with the mating rail 8. During this working step, it is possible for the welding jaws 11 to be still shut and to form the transverse weld seam. The loading rail 14 has holes through which needles 12 extend upwards so that the newly formed bag is spiked on such needles. The needles 12 are firmly mounted on an angle section of support 5.

The gripping rail 6 also has holes so that the individual bags may be slipped onto the needles 12. A recess 14 under the groove 7 in the mating rail 8 serves to receive the edges of the bags without their being crumpled.

The device described with reference to the drawing is essentially similar to the device described in the German patent publication 3,204,492 A so that for further details reference may be had to same.

However there is a departure in the described device from the earlier known device, since the fed rolls and 2 forming a pair of advancing rolls may be turned back against the direction of feed, (indicated by the arrow,) of the web 3 prior to operation of the cutting knife and the welding jaws. This backward rotation of the feed rolls 1 and 2 means that the section of web 3, which has previously been freely drawn forward, is tensioned so that it does not have any slack and does not lie in folds. Reverse rotation of the feed rolls may, for example, be effected by any suitable form of reversing drive.

I claim:

1. A device for transverse cutting and welding of webs of thermoplastic material comprising a pair of feed rolls for feeding the web in steps equal to a length to which the web is to be cut, a transverse cutting device for cutting the web between each step into segments of said length, a transverse welding device for forming transverse welds in the web, two vertically movable transversely extending parallel rails displaced from each other in a feed direction of the web of which one of the rails which is downstream of the other of the rails in the feed direction acts as a gripping rail for pressing the web against a support and the other of said rails is disposed between the cutting device and said one rail and acts as a tautening rail for tautening the web between the feed rolls and the gripping rail before it is cut, and means for reversing rotation of the feed rolls after operation of the gripping rail and prior to operation of the cutting device and the welding device, so that said feed rolls feed the web in said cutting length steps by feeding the web in lengths greater than said cutting length with said reversing operating to partially draw back the web between each cut.

2. The device as claimed in claim 1, characterized in that the tautening rail operates to tauten the web during or after its backward motion.

3. The device as claimed in claim 1, characterized in that the cutting device contacts the web while the web is being drawn back.

* * * * *